US005319433A

United States Patent [19]

Fukushima et al.

[11] Patent Number: 5,319,433

[45] Date of Patent: Jun. 7, 1994

[54] ELECTROPHOTOGRAPHING APPARATUS FOR FORMING COLOR IMAGE

[75] Inventors: Hisashi Fukushima, Kawasaki; Nobuatsu Sasanuma, Yokohama; Tetsuya Atsumi, Tokyo, all of Japan

[73] Assignee: Canon Kabushiki Kaisha, Tokyo, Japan

[21] Appl. No.: 62,222

[22] Filed: May 18, 1993

[30] Foreign Application Priority Data

May 18, 1992 [JP] Japan ..... 4-149952
Jun. 26, 1992 [JP] Japan ..... 4-193109

[51] Int. Cl.[5] ..... G03G 15/01

[52] U.S. Cl. ..... 355/326 R; 346/160; 355/208; 355/210; 358/448

[58] Field of Search ..... 355/326 R, 327, 328, 355/210, 203, 208, 214; 346/153.1, 157, 160; 358/461, 458, 448

[56] References Cited

U.S. PATENT DOCUMENTS 4,984,285 1/1991 Kano et al. ..... 358/461 X
5,025,272 6/1991 Haneda et al. ..... 346/153.1
5,077,605 12/1991 Ikeda et al. ..... 358/461 X
5,245,445 9/1993 Fujisawa ..... 358/458
5,249,068 9/1993 Takase ..... 358/461

FOREIGN PATENT DOCUMENTS 61-117572 6/1986 Japan .
61-120175 6/1986 Japan .

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

The present invention provides an electrophotographing apparatus for forming a color image of an improved image quality. For the provision of such an apparatus, a plurality of color developing means are arranged in the traveling direction of the electrophotographing member. The length of the traveling direction of the photosensitive member becomes longer, and the dark attenuation characteristics are created. The resultant problems which tend to lower the image quality are solved.

In consideration of the dark attenuation characteristics of an electrophotographing photosensitive member, the present invention performs fine color adjustments according to each color of an developing image. In this adjustment, the gradation is corrected, or the color is corrected, per color in accordance with the dark attenuation characteristic.

9 Claims, 10 Drawing Sheets

ELECTROPHOTOGRAPHING APPARATUS FOR FORMING COLOR IMAGE

BACKGROUND OF THE INVENTION

1. Field of the Invention

The present invention relates to an electrophotographing apparatus for a copying machine, a laser printer, and the like. More particularly, the invention relates to an electrophotographing apparatus wherein a plurality of developing devices are arranged around a photosensitive member, and the image forming conditions are being controlled for each color in accordance with the dark attenuation characteristic of the photosensitive member.

2. Related Background Art

A photosensitive member which is generally used for an electrophotographing apparatus for a copying machine and others generates the so-called "dark attenuation", that is, if the photosensitive member is left intact after once charged by an electrostatic charger, its charged potential is lowered (the amount of the charged potential is reduced). This dark attenuation (potential reduction) is known to be increased as the time elapses. If, for example, a photosensitive member rotates, the dark attenuation will increase in accordance with the distance that the photosensitive member has traveled after the electrostatic charging.

Meanwhile, there is known an electrophotographing apparatus which is provided with a plurality of developing devices arranged around the photosensitive member. A full color copying machine having four developing devices for four color toners, each in cyan, magenta, yellow, and black, can be cited in this respect, for example. The above-mentioned four developing devices are arranged around the photosensitive member in different positions along its rotational direction thereby to apply the toners in each color to the corresponding latent images sequentially. Therefore, the distances to each of the developing devices from the position (the position of an electrostatic charger) where the electrostatic charge is given to the photosensitive member are different, respectively, when the distances are measured along the peripheral direction of the photosensitive member. The distance from the charging position to the developing device having yellow toner is shortest; to the device having cyan toner, the next; then to the device having magenta toner, the next; and to the device having black toner, the longest. Because of the difference in distance, the time required for beginning the development by each of the developing devices after the photosensitive member is charged is different depending on the respective developing devices. Thus, the resultant amount of the dark attenuation of the photosensitive member at the time of the development differs inevitably. In other words, depending on the position of each developing device, the dark attenuation amount of the photosensitive member differs a the time of the development.

When the amount of the dark attenuation differs as in this case, the density of the toner image after the development differs even if the amount of the electrostatic charge provided by the charger is the same; hence making it difficult to obtain high-quality images.

In order to avoid this drawback, the applicant hereof has proposed as given below. In other words, in Japanese Patent Laid-Open No. 61-120175, a provision of a controlling means is proposed so as to control and vary the output of an electrostatic charger in accordance with the developing device selected from the plural developing devices (the difference in the dark attenuation due to the difference in its position). Also, in Japanese Patent Laid-Open No. 61-117572, a provision of a image density adjusting mean is proposed so as to modify and adjust the developing bias voltage or the image exposure amount per developing device in accordance with the amount of the dark attenuation of the photosensitive member. With this image density adjusting means, it is possible to obtain the same level of image density at all times under a given condition of density adjustment set by an operator.

However, according to the conventional examples set forth above, there are some cases where the gradient tonality of the intermediate tone of an original image becomes different even when the image density is regular. Particularly, in a color image recording apparatus or the like for which a severe reproduction of the intermediate tone is demanded, there is a possibility that this difference in the tonality leads to a defective image.

Further, the dark attenuation characteristic of a photosensitive member varies as the time elapses. Consequently, even if the density adjustment including the intermediate tonality is properly made at the outset of using an image recording apparatus, the intermediate tones will become imbalanced as the apparatus is in use for a long period of time.

SUMMARY OF THE INVENTION

It is, therefore, an object of the present invention to provide an image recording apparatus capable of improving the quality of an image in accordance with the dark attenuation characteristic of its photosensitive member In order to achieve the above-mentioned object, an electrophotographing apparatus for forming a color image according to the present invention comprises an endlessly traveling electrophotographing photosensitive member; electrostatic charging means for charging the photosensitive member before optical information is irradiated onto the photosensitive member; optical means for irradiating color image information onto the photosensitive member; a plurality of color developing means having different color toners, respectively, which are sequentially arranged on the downstream side of the position where the optical information is irradiated by the above-mentioned optical means irradiating in observing the photosensitive member in its traveling direction; dark attenuation amount detecting means for detecting the dark attenuation amount of the photosensitive member in accordance with the position of each developing means; and gradient correcting means for correcting the gradient of the image developed by each developing means on the basis of the result of the detection by the above-mentioned dark attenuation amount detecting means.

Also, it may be possible to provide color correcting means for each of the developing means in place of the above-mentioned gradient correcting means.

DETAILED DESCRIPTION OF THE PREFERRED EMBODIMENTS

Hereinafter, in conjunction with the accompanying drawings, the description will be made of the embodiments according to the present invention.

First Embodiment

Figure 1:
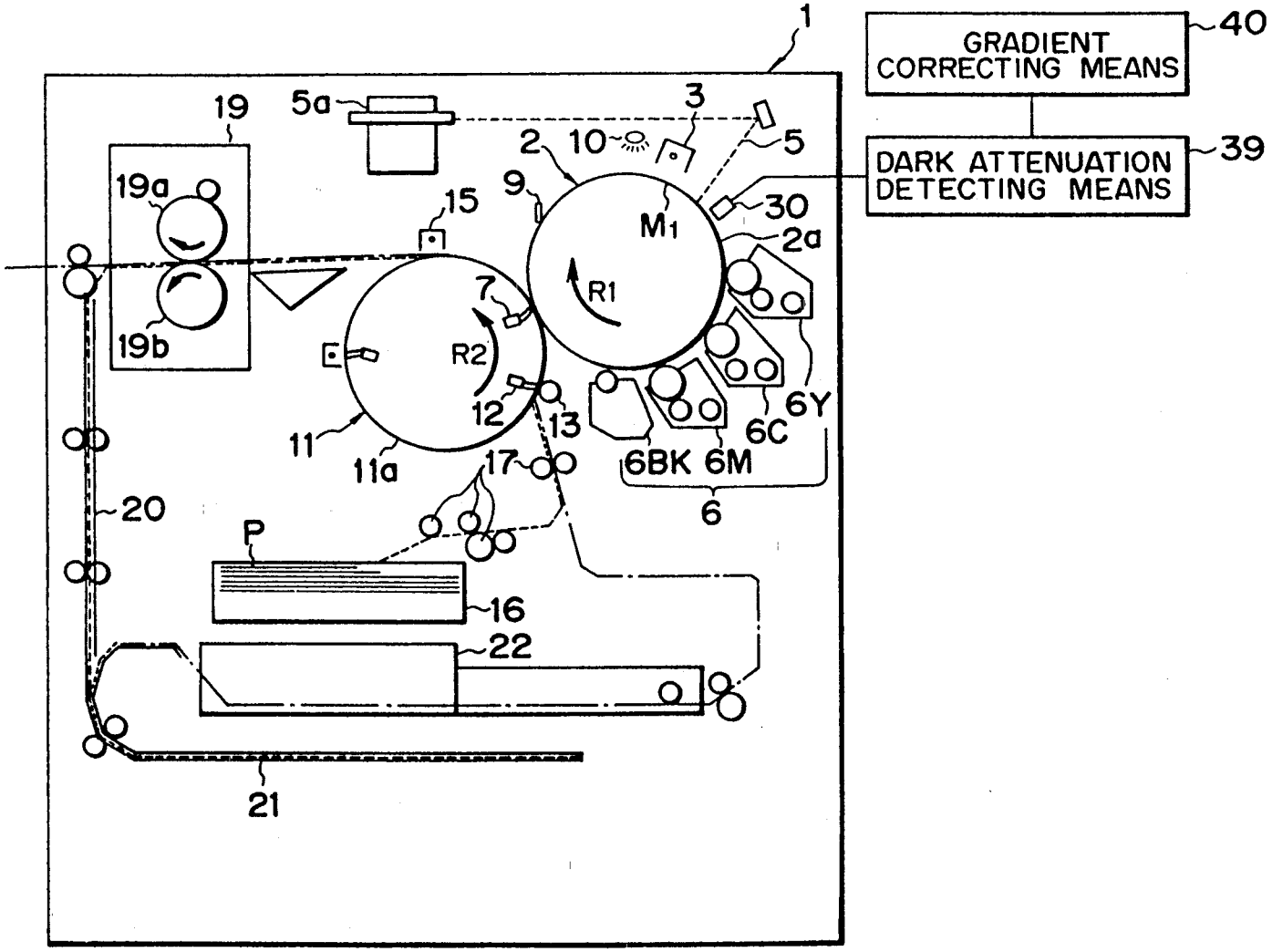
FIG. 1 is a cross-sectional view schematically showing an image recording apparatus according to a first embodiment.

FIG. 1 illustrates the outline of a four full color laser beam printer as an image recording apparatus. This apparatus is provided with an electrophotographing photosensitive drum 2 supported by the apparatus main body 1 rotatively in clockwise direction. On the outer periphery of the cylindrical photosensitive drum 2, the surface (photosensitive member) 2*a* of a photosensitive layer is formed. This photosensitive surface 2*a* is sequentially traveled in the direction indicated by an arrow R1 as the photosensitive drum 2 rotates. On the circumference of the photosensitive surface 2*a*, an electrostatic charger 3, an exposure device 5, developing devices 6, a transfer electrostatic charger 7, a cleaning device 9, a front exposure lamp 10 which deelectrifies any residual charge, and others are arranged in that order. The developing devices 6 comprise four devices 6Y, 6C, 6M, and 6 Bk each having different color toner, that is yellow, cyanogen, magenta, and black, respectively. The distances (measured from the charging position M1 opposite to the electrostatic charger 3 on the photosensitive drum 2 along the photosensitive surface 2*a*) to these developing devices 6Y, 6C, 6M, and 6Bk become loner as arranged in that order.

Further, there is arranged a transfer drum 11 which rotates in the direction indicated by an arrow R2 while in contact with the photosensitive surface 2*a* of the photosensitive drum 2. The transfer drum 11 has a cylindrical transfer sheet 11*a*. Around the transfer sheet 11*a*, an absorptive electrostatic charger 12 for attracting a transfer medium to the drum electrostatically, an absorptive roller 13, a separating electrostatic charger 15 for separating the transfer medium from the drum after a given transfer process.

Under the transfer drum 11, a sheet supply cassette 16 is set to contain the printing sheets for which the image is printed. Between the sheet supply cassette 16 and the transfer drum 11, a roller group 17 comprising a sheet supply roller, feed roller, regist roller, and others is arranged. Also, on the downstream side of the transfer drum 11, a fixing device 19 is provided. Here, in the laser beam printer shown in FIG. 1, a re-feeding pass 20, a reversing pass 21, an intermediate tray 22, and others are arranged in order to form an image again on the reverse side of the printing sheet P.

Further, in a position before a developing device 6Y slightly on the downstream side of the charging position M1 of the photosensitive drum 2, a surface potential sensor 30 structured as conventionally known is arranged to face the photosensitive surface 2*a* for the detection of the electrostatic charging potential of the photosensitive surface 2*a*.

Now, subsequently, the operation of the laser beam printer will be described.

At first, the photosensitive drum 2 rotates in the direction indicated by an arrow R1 to cause the dielectric transfer sheet 11*a* on the transfer drum 11 which is in contact therewith to rotate also in the direction indicated by an arrow R2. After the photosensitive surface 2*a* of the photosensitive drum 2 is deelectrified by the front exposure lamp 10, the surface is charged by the electrostatic charger 3 and modulated by black image signals. Then, a black electrostatic latent image is formed on the photosensitive surface 2*a* by a laser light carrying the digital optical information that is obtained by the polygon scanner 5 of an exposing device 5, and a toner image is formed by applying a black developer (toner) by the developing device 6Bk to this electrostatic latent image.

On the other hand, the printing sheet P in the supply sheet cassette 16 is fed by a roller group 17 through the sheet passage (represented by dotted line in FIG. 1) is attracted to the transfer sheet 11 by charging it in a given timing by means of the absorptive electrostatic charger 12 and the dielectric absorptive roller 13 which is grounded. In the transferring unit, the appeared image (toner image) developed by the developing device 6Bk for black color is transferred to the printing sheet P by the transfer electrostatic charger 7. The transfer drum 11 continues its rotation to make it prepared for the next color transfer (magenta in FIG. 1).

Meanwhile, the residual toner on the photosensitive surface 2*a* of the photosensitive drum 2 is cleaned by the cleaning device 9, and the surface is deelectrified by the irradiation of the front exposure lamp 10. Then, it is again charged by the electrostatic charger 3 to receive the exposure by the next color image signals. After the development and transfer of the next color, and further, subsequent to the repetition of these processes given to the other colors, the printing medium P is separated from the transfer sheet 11*a* by separating means such as the separating electrostatic charger 15 and is fed to a hot roller 19*a* and pressure roller 19*b* in the fixing device 19, hence terminating a series of full color printing sequences to form a desired image printed in full color.

Figure 7:
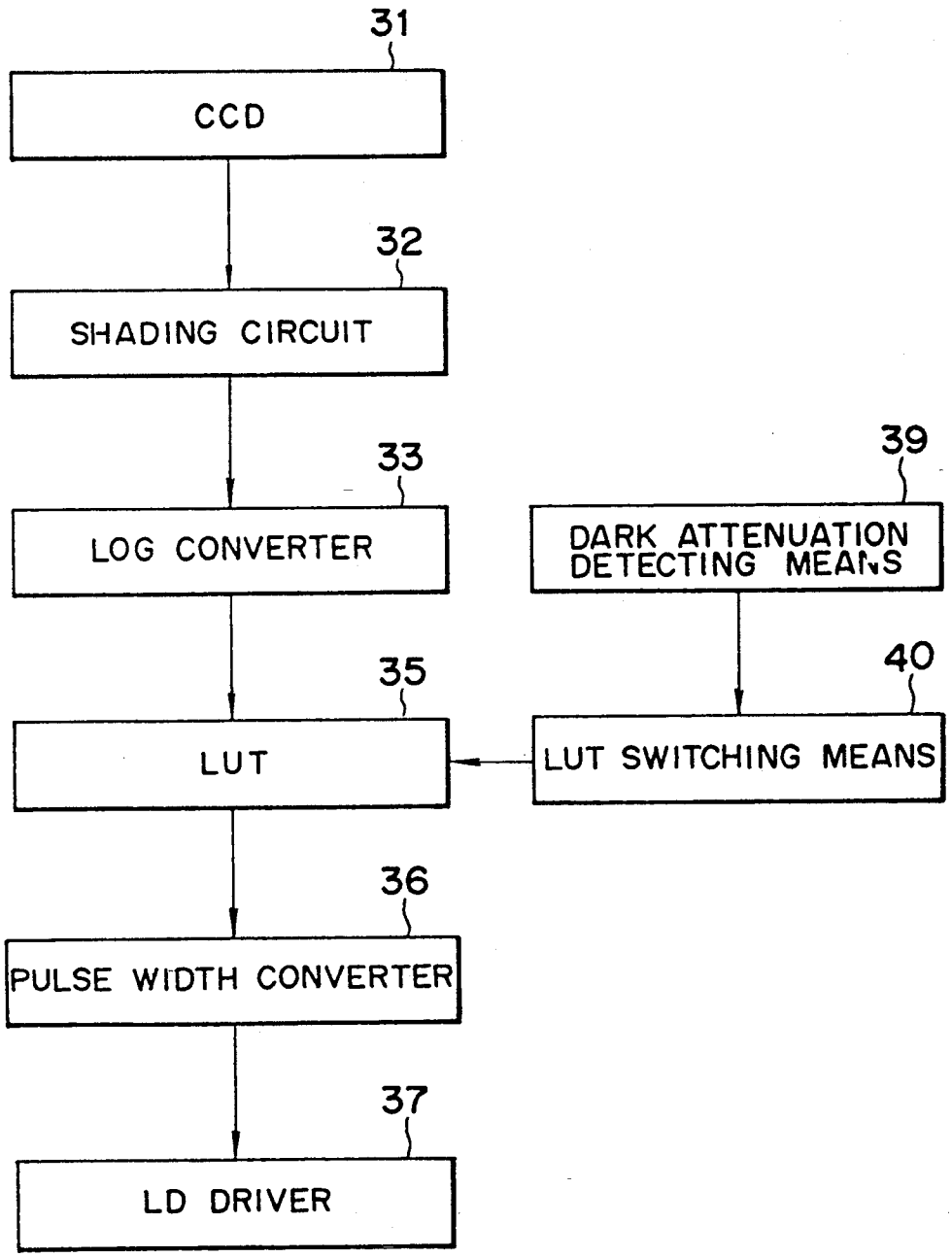
FIG. 7 is a block diagram showing the operation of dark attenuation detecting means.

FIG. 7 is a block diagram schematically showing the signal processing system in such a laser beam printer as this. In FIG. 7, the luminance signal which corresponds to the image obtainable by reading the original image is obtained through the CCD 31 serving as elements to read, for example. The luminance signal thus obtained passes a shading circuit 32 which corrects the sensitivity fluctuation of each CCD. The luminance signal thus corrected passes an LOG converter 33 in order to convert the corrected luminance signal to the density signal. The density signal thus obtained is converted by an LUT 35 to correct the gradient changes affected by the development characteristic of the electrophotographing system and then, converted by a pulse width converter 36 to a signal corresponding to the dot width; hence being transmitted to a laser driver 37.

With the digital signal processing described above, an electrostatic latent image having a gradient characteristic due to the dot area variation is formed by the laser scan on the photosensitive surface 2a of the photosensitive drum 2. Thus, a gradient image is obtained through the development, transfer, and fixation processes. When a full color gradient image is to be reproduced, a color separation, base color removal, masking, and other processes are added to process a plurality of color signals in parallel. However, the gradient reproduction of each color is executed in the same manner as in the case of a single color described above.

In the embodiments according to the present invention, what is featured is that a plurality of LUT (look up tables) 35 are provided as shown in FIG. 7, and instruction signals to an LUT switching means 40 which serves as gradient correcting means are changed in accordance with the detected signal from the dark attenuation detecting means 39 which is provided with the foregoing surface potential sensor 30 so that an optimal LUT is selected.

The dark attenuation detecting means 39 is structured as given below, for example.

Assuming that the operational timing is such as the main power source being turned on, and that the temperature of the hot roller 19a of the fixing device 19 is lower than the fixing temperature by 30° C. or more, the interval is short enough to catch the variation of the dark attenuation characteristic, and there is also an advantage that the loss time inevitably needed for detecting the dark attenuation amount can be included in a wait time. At first, approximately a half circle of the photosensitive surface 2a of the photosensitive drum 2 is charged by the electrostatic charger 3. Then, the electrostatic charging potential at a specific position of the photosensitive surface 2a is measured by the surface potential sensor 30 (first rotation potential in FIG. 4) with the image exposing light of the exposing device 5 being turned off. At this juncture, the developing rollers of the developing devices 6Y, 6C, 6M, and 6Bk are mechanically parted from the surface of the photosensitive drum so that no development is executed. The transfer electrostatic charger 7 is also turned off. The front exposure lamp 10 is not illuminated, either. The charged potential at the above-mentioned specific position is measured after the photosensitive drum 2 is rotated once while the inside of the apparatus is dark, and is stored (second rotation potential in FIG. 4). Both for the first rotation and the second rotation, the potentials at the positions 180 degrees opposite to them on the photosensitive drum 2 are averaged so as to eliminate any variation of the charged amounts and measurement errors due to the eccentricity and the like of the photosensitive drum 2. Subsequently, the photosensitive drum 2 rotates only with the front exposure lamp 10 being turned on to execute the deelectrification evenly, thus terminating the process to detect the dark attenuation amount.

Figure 4:
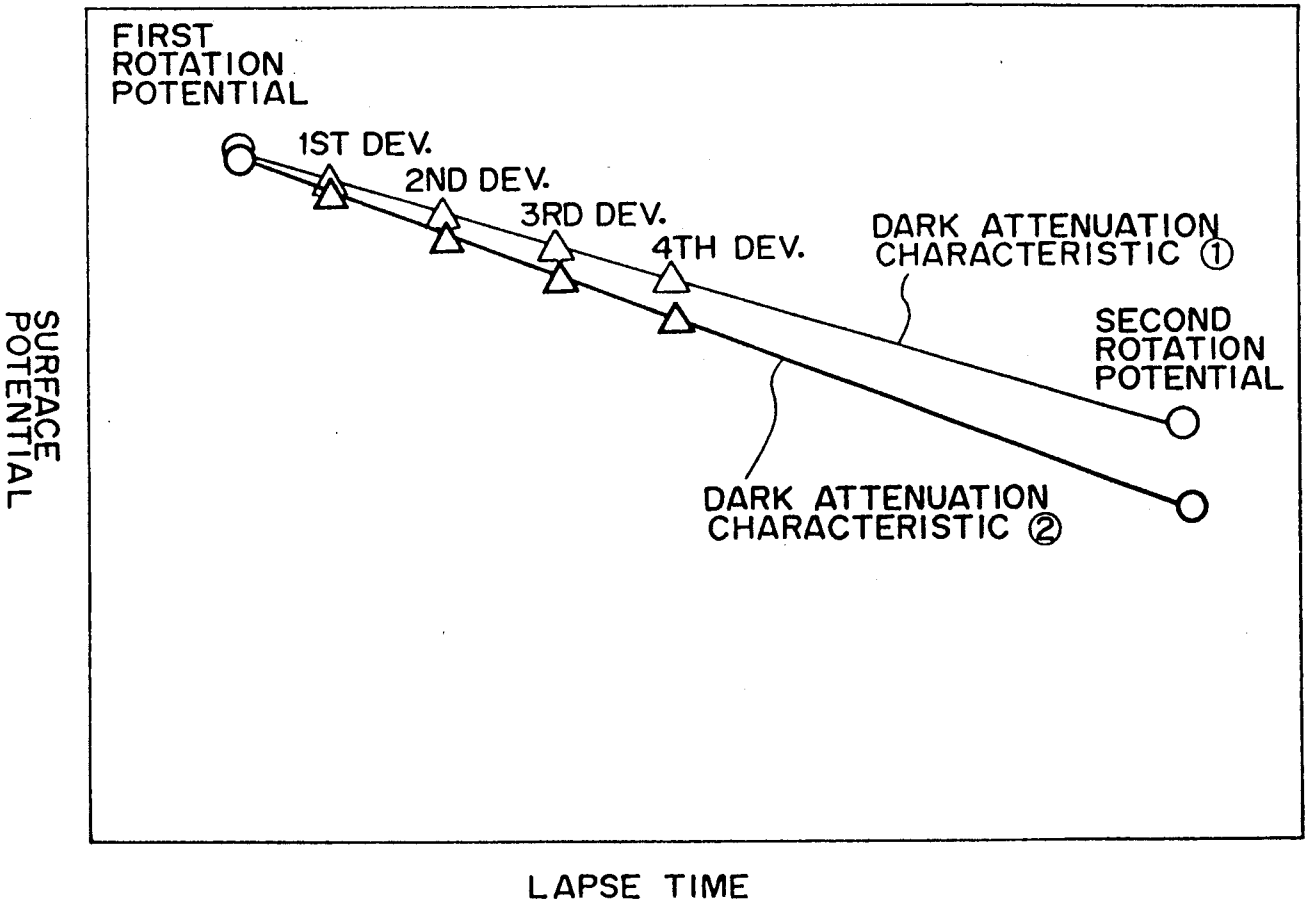
FIG. 4 is a view showing the relationship between the elapsed time and the surface potential after the electrostatic charging according to the first embodiment.

In FIG. 4 which schematically shows the elapsed time and the surface potential with the charging position M1 as its reference, the elapsed time corresponding to each of the arrangement distances to the developing devices 6Y, 6C, 6M, and 6Bk is measured by linearly interpolating the first rotation potential and the second rotation potential on the photosensitive drum 2 having the dark attenuation characteristic ①. Thus, the dark attenuation amount corresponding to each of the developing devices 6Y, 6C, 6M, and 6Bk is estimated. When the dark attenuation amounts are thus estimated, the gradient tonality of the intermediate tone can also be estimated in each of the arrangement positions of the developing devices 6Y, 6C, 6M, and 6 Bk. Then, the LUT suitable for each of the intermediate gradient tonalities is selected by the LUT switching means 40 to execute the intermediate gradient correction for each color.

Figure 2:
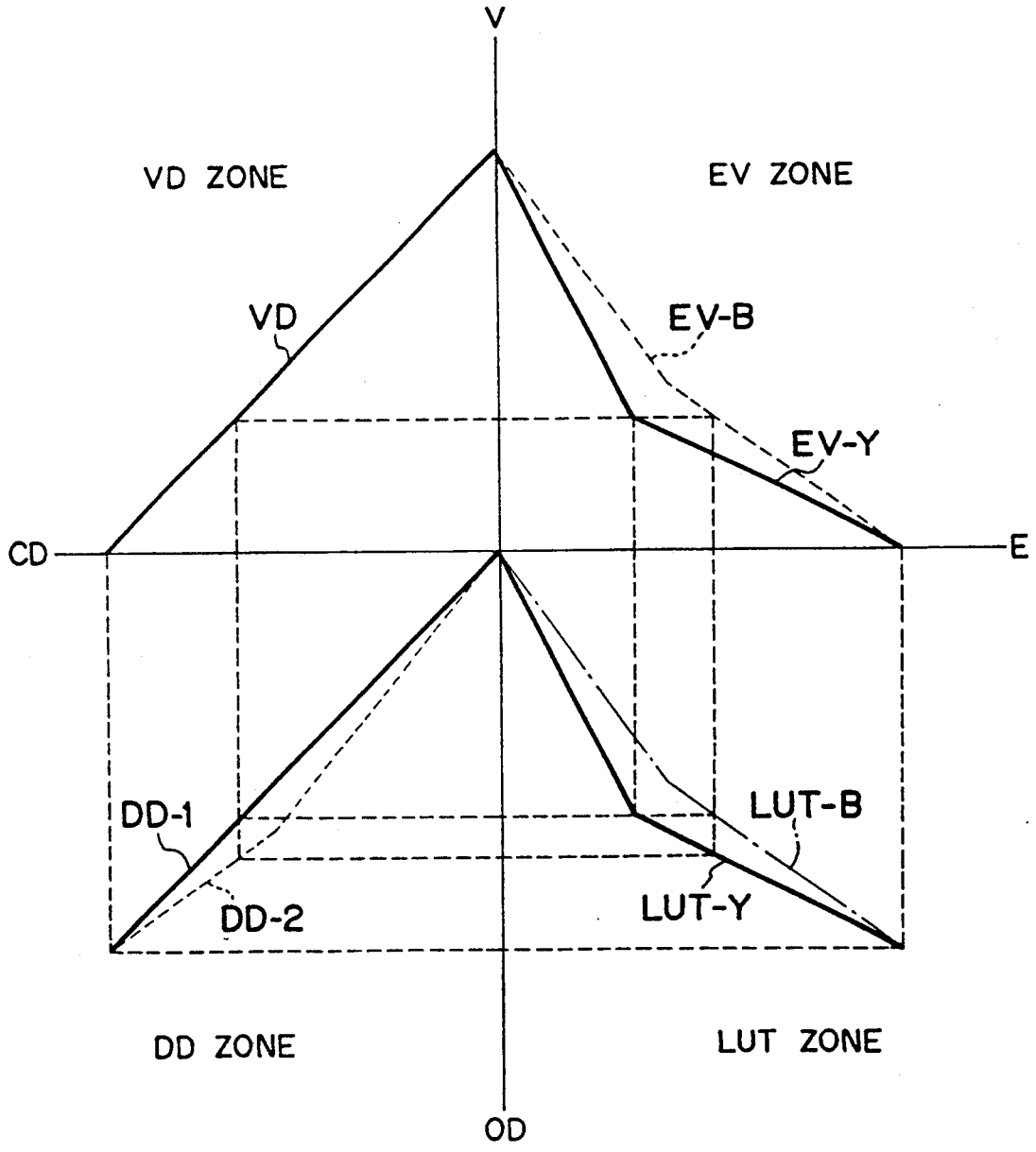
FIG. 2 is a view showing a sensitometry.

FIG. 2 illustrates a sensitometory whereby to show the switching of the LUT 35 schematically. In FIG. 2, the original density signal OD represents the signal before an LUT 35 shown in FIG. 7 (signal corresponding to the original density), and the exposure E represents the signal after the LUT 35. A reference mark V designates a regulated charge potential on the photosensitive surface 2a of the photosensitive drum 2, and CD, a regulated optical density of a recording image. As a DD-1 indicated by a solid line in the DD zone, it is ideal that the OD and CD is in a linear relation.

In forming an image corresponding to the yellow developing device 6Y which has the least dart attenuation of the four developing devices, the signal is converted at the LUT-Y as a set indicated by the solid line in FIG. 2, and a linearly gradient characteristic is obtainable as represented at DD-1 through an EV characteristic at EV-Y and a VD characteristic at VD. On the other hand, in forming an image corresponding to the black developing device which has the greatest dark attenuation amount of the four developing devices, the EV characteristic which is regulated in the EV zone for the dark attenuation becomes the EV-B, and if the LUT-Y is applied, it will represent an unideal DD characteristic at DD-2. Therefore, in the present embodiment, the difference in types EV-Y and EV-B corresponding to the difference in the dark attenuation amounts is measured in advance, and it is intended to assure for B a DD characteristic at DD-1 by applying the LUT-B.

When the dark attenuation amounts are measured at given intervals and the photosensitive drum 2 shows the varied characteristics as represented by the dark attenuation characteristic ② in FIG. 4, the intermediate gradient correction is performed as described earlier on the basis of the estimated dark attenuation amounts corresponding to the respective developing devices 6Y, 6C, 6M, and 6Bk in order to assure a stabilized intermediate tonal characteristic at all times.

In this respect, the operational timing is not necessarily limited to the timing described earlier, but it may be possible to execute the required operations at given intervals with the provision of a timer, or it may be possible to execute them per given number of prints. In some cases, these may result in a better fitness to the degree of the degradation of the photosensitive drum 2. Also, the charging area is not limited to the one described earlier, but it may be possible to charge the entire periphery of the photosensitive surface 2a of the photosensitive drum 2 thereby to adopt the averaged potential of the entire periphery. With this, there should be an effect that the variations of the charging characteristic of the photosensitive drum 2 can be offset. Further, it may be possible to speed up the rotation of the photosensitive drum 2 when it is in the mode of dark attenuation measurement. The rotation of the photosensitive member is not limited to only once, either. It may be possible to rotate the photosensitive member more than once within a range where the linearity of the dark attenuation characteristic can be obtained.

Second Embodiment

The LUT switching means 40 for switching the LUT 35 is used in the first embodiment as the gradient correcting means. Beside this, it is possible to satisfy both the maximum density and the gradient tonality at the same time by executing the gradient correction by use of the LUT 35 subsequent to the modification and adjustment of the latent image forming conditions and/or developing conditions corresponding to each of the developing devices 6Y, 6C, 6M, and 6Bk beforehand in accordance with the respective amounts of the dark attenuation.

Third Embodiment

Figure 3:
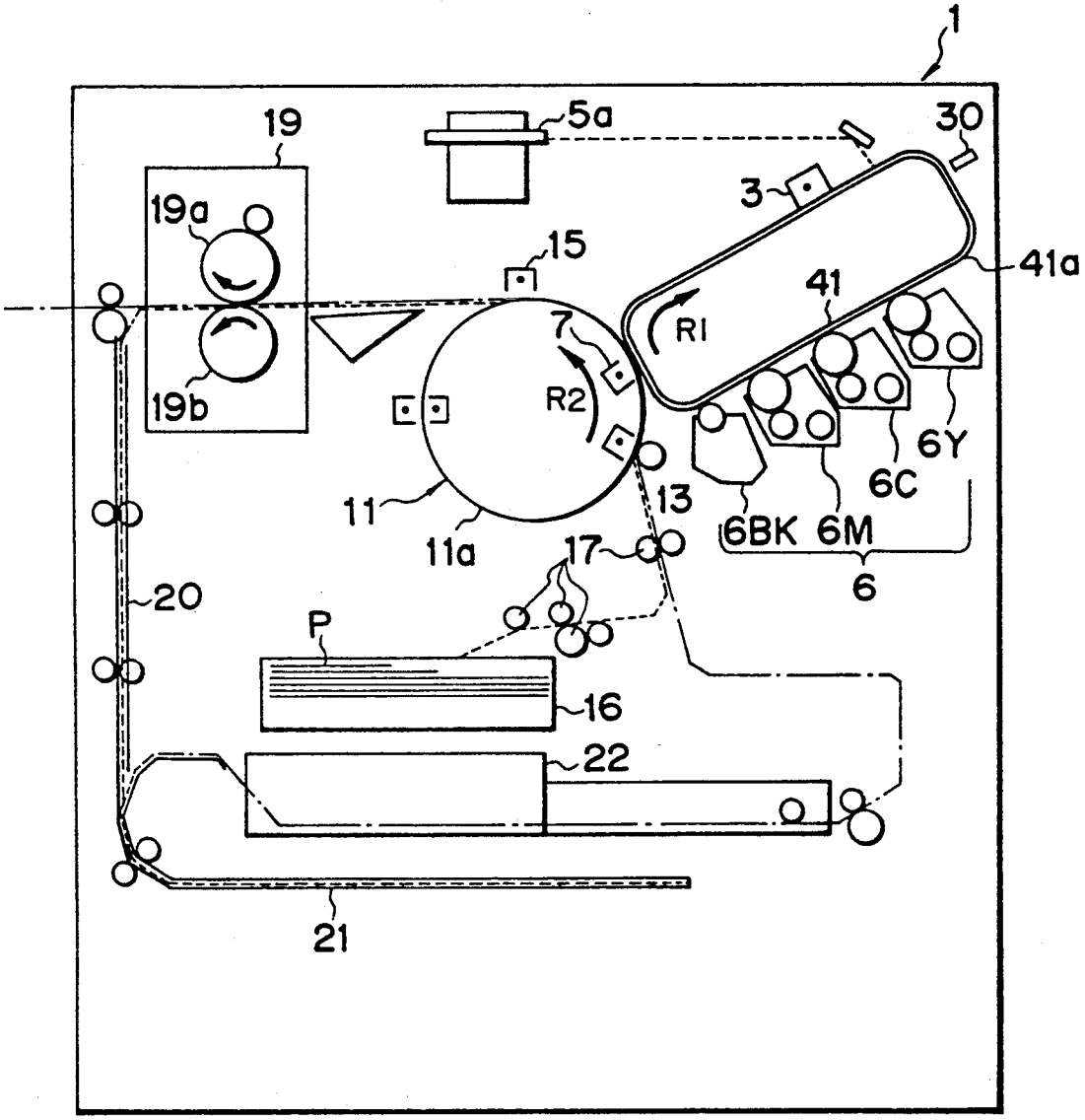
FIG. 3 is a cross-sectional view schematically showing an image recording apparatus according to a third embodiment.

In the first embodiment, an example is shown, in which the photosensitive surface 2*a* is formed on the surface of the cylindrical photosensitive drum 2, and then, a plurality of developing devices, 6Y, 6C, 6M, and 6Bk, are arranged in the rotational direction of the photosensitive drum. Beside this, it is possible to use an endlessly traveling photosensitive belt 41 as shown in FIG. 3 instead of the photosensitive drum 2, for example. In this case, on the outer surface of the photosensitive belt 41, a photosensitive layer surface 41*a* is formed. Thus, the four developing devices 6Y, 6C, 6M, and 6Bk can be arranged on the straight portion of the photosensitive belt 41, making it possible to regulate the structure and configuration of each of the developing devices 6Y, 6C, 6M, and 6Bk and obtain an advantage that not only its fabrication becomes easier, but also it will suffice if only a consideration is given to the correction of the difference in image due to the difference in the dark attenuation corresponding to the positions of the developing devices. Hence, it is possible to make the required correction algorithm simpler because there is no need for executing the charging correction including the structural difference of the developing devices.

Fourth Embodiment

Figure 5:
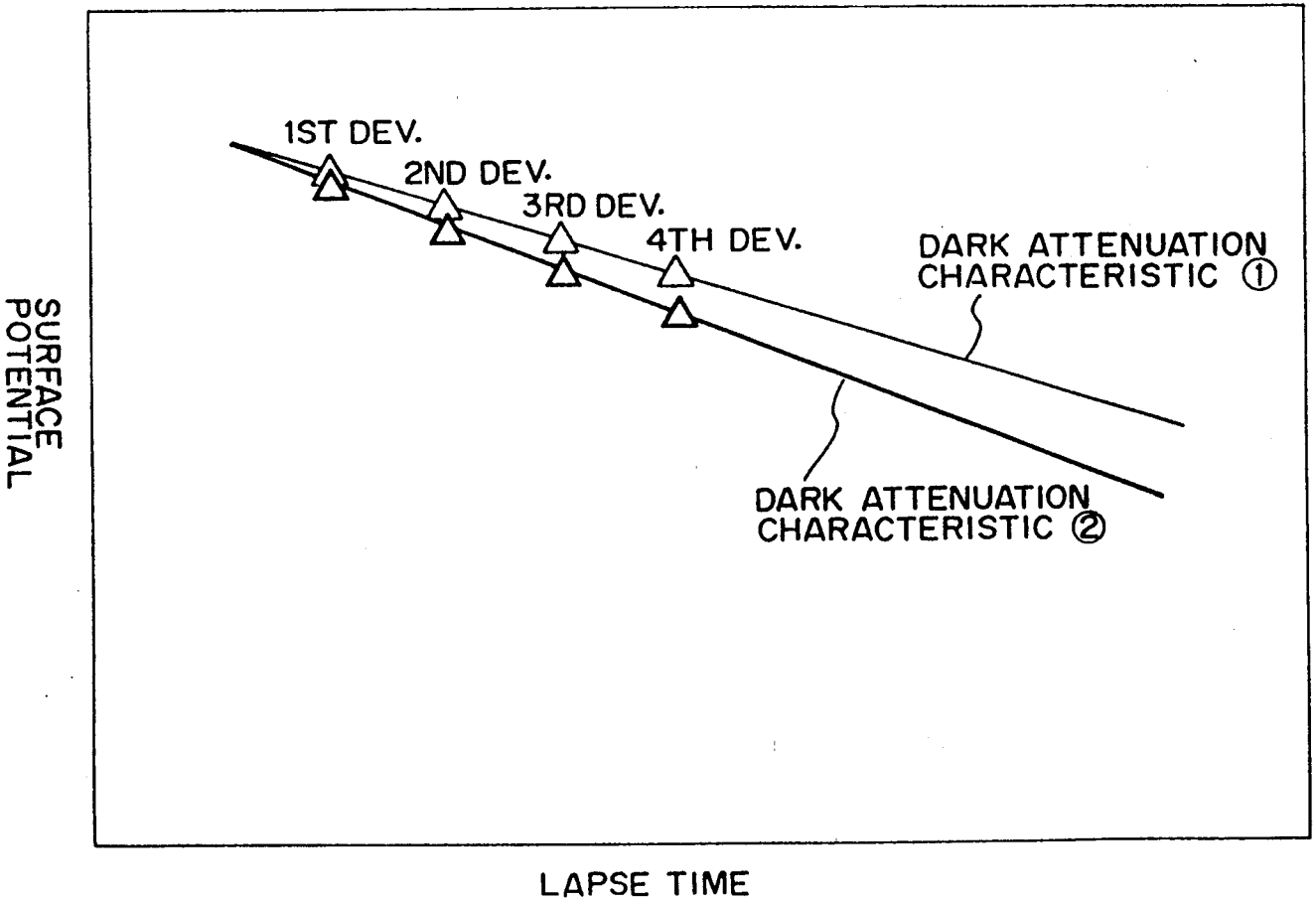
FIG. 5 is a view showing the relationship between the elapsed time and the surface potential after the electrostatic charging according to the fourth embodiment.

The example of the aforesaid dark attenuation detecting means 39 is not limited to the one disclosed in the first embodiment. It is possible for a dark attenuation detecting means 39 to be provided with a surface potential sensor 30 thereby to give a charge of a specific amount to the photosensitive surfaces 2*a* and 41*a* by arranging the aforesaid surface potential sensor 30 to face the photosensitive drum 2 or the photosensitive surfaces 2*a* and 41*a* of the photosensitive belt 41. When this charging position reaches the surface potential sensor 3, the traveling of the photosensitive surfaces 2*a* and 41*a* is suspended for a given period of time. The potential of this charging position is again measured. In this way, it may be possible to arrange a structure so that the dark attenuation characteristic of the photosensitive drum or the photosensitive belt 41 is detected. The dark attenuation characteristics are measured as represented in FIG. 5 which illustrates the relationship between the surface potential on the photosensitive surface 2*a* or 41*a* and the elapsed time while it is left intact in the darkness in order to perform the intermediate gradient correction as described earlier.

Fifth Embodiment

Figure 6:
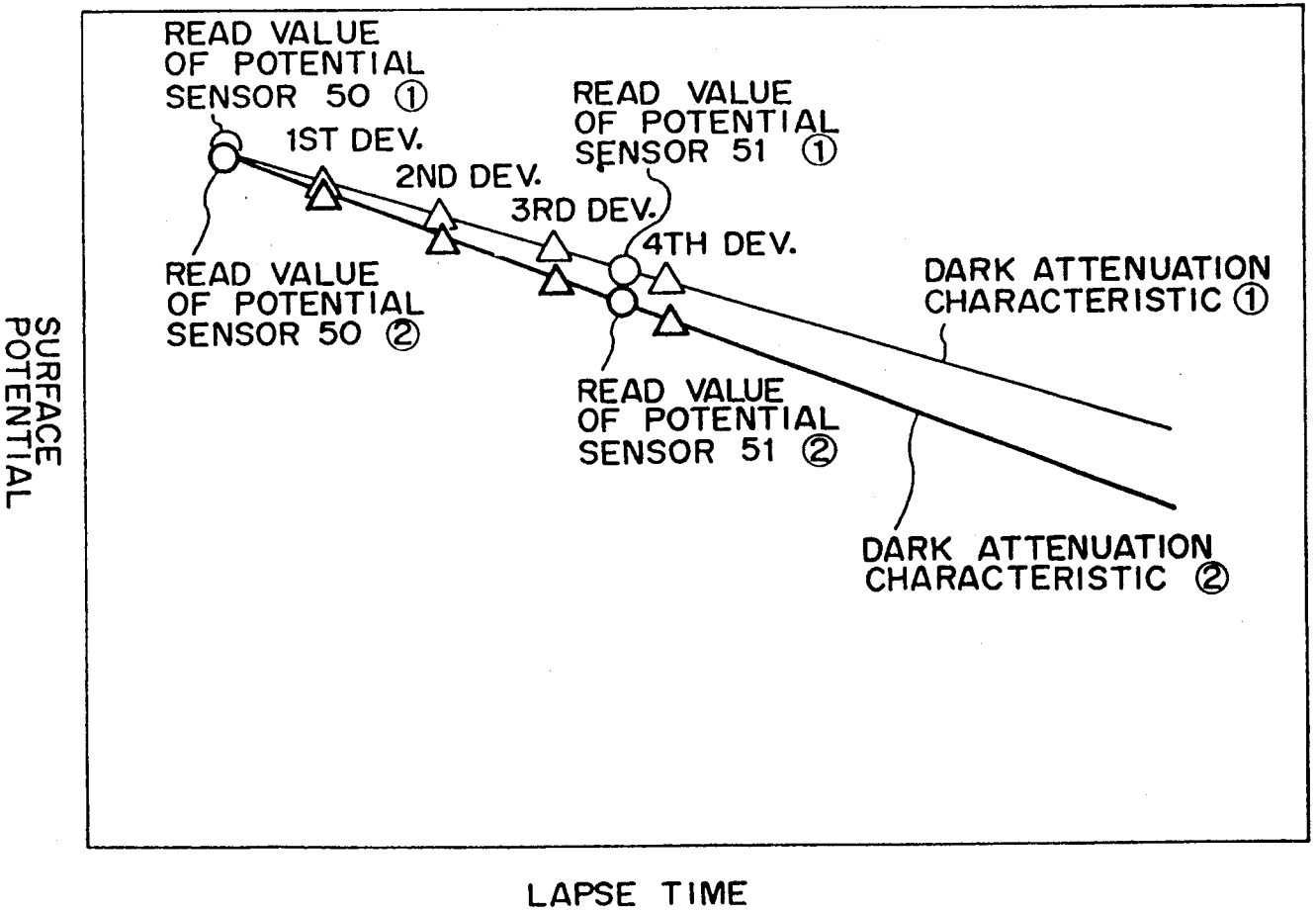
FIG. 6 is a view showing the relationship between the elapsed time and the surface potential after the electrostatic charging according to the fifth embodiment.
Figure 8:
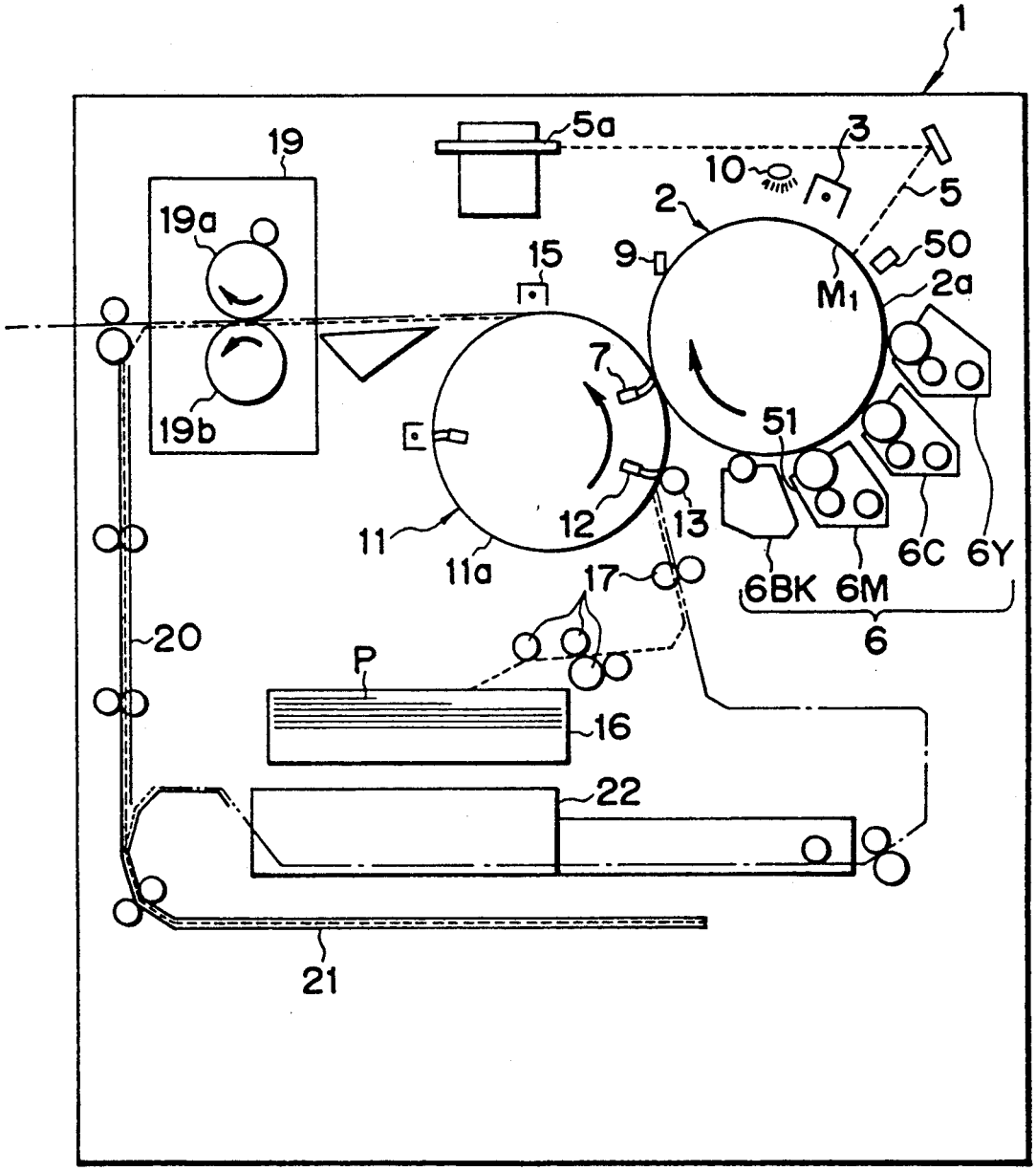
FIG. 8 is a cross-sectional view schematically showing an image recording apparatus according to a fifth embodiment.

As another example of the dark attenuation detecting means, it is possible to arrange a plurality of surface potential sensors for dark attenuation detecting means 39 as shown in FIG. 8. Around the photosensitive drum 2, a plurality of surface potential sensors are arranged at given intervals in the traveling direction of the photosensitive surface 2*a*. Thus, from the difference in the plural charge potentials and the time corresponding to the given intervals, the dark attenuation characteristics of the photosensitive drum 2 are detected For example, a surface potential sensor 50 is arranged on the upper stream side of the developing device 6Y and also, a surface potential sensor 51 arranged for the developing devices 6M and 6Bk. From the difference in the values read by both of the sensors, the dark attenuation characteristic of the photosensitive drum 2 may be estimated as shown in FIG. 6. Compared to those arrangements in the foregoing embodiments from 1 to 4, the arrangement according to this embodiment has an advantage that the required detection can be executed in the image formation sequence without any loss time, and that the operational timing can be set more arbitrarily. The present embodiment is characterized by the provision of plural surface potential sensors, and the locations and numbers of the sensors to be arranged are not limited to the above-mentioned example.

In all of the above-mentioned embodiments, the description has been made of the case where the photosensitive dram 2 or the photosensitive belt 41 i exposed by use of a laser beam, and the so-called inverted development in which toners are applied by the developing devices 6 to the regions thus exposed is adopted. It is readily understandable, however, that the present invention is applicable to an image recording apparatus using a regular development where a toner is also applied to the dark region, that is, the photosensitive region which is not exposed.

As set forth above, in an image recording apparatus having a plurality of developing devices in the traveling direction of the photosensitive member, dark attenuation detecting means is provided to detect the dark attenuation amounts corresponding to the arrangement distances from an electrostatic charger, and then, by performing the gradient correction per developing device in accordance with the results of the detection by the dark attenuation detecting means. In this way, even if the photosensitive characteristic of a photosensitive member is changed due to a long time use, for example, it is possible to obtain an excellent reproduction of the intermediate tonality and enable the maintenance of a higher quality image at all times.

Sixth Embodiment

Hereinafter, in conjunction with the accompanying drawings, a sixth embodiment will be described, but the description will be confined to the aspects which differ from the above-mentioned embodiments. Also, in this respect, since the color converting circuit, the color converting coefficient, and the operation are disclosed in U.S. Ser. No. 519,498 (filed on May 4, 1990), any detailed description thereof will be omitted.

Figure 9:
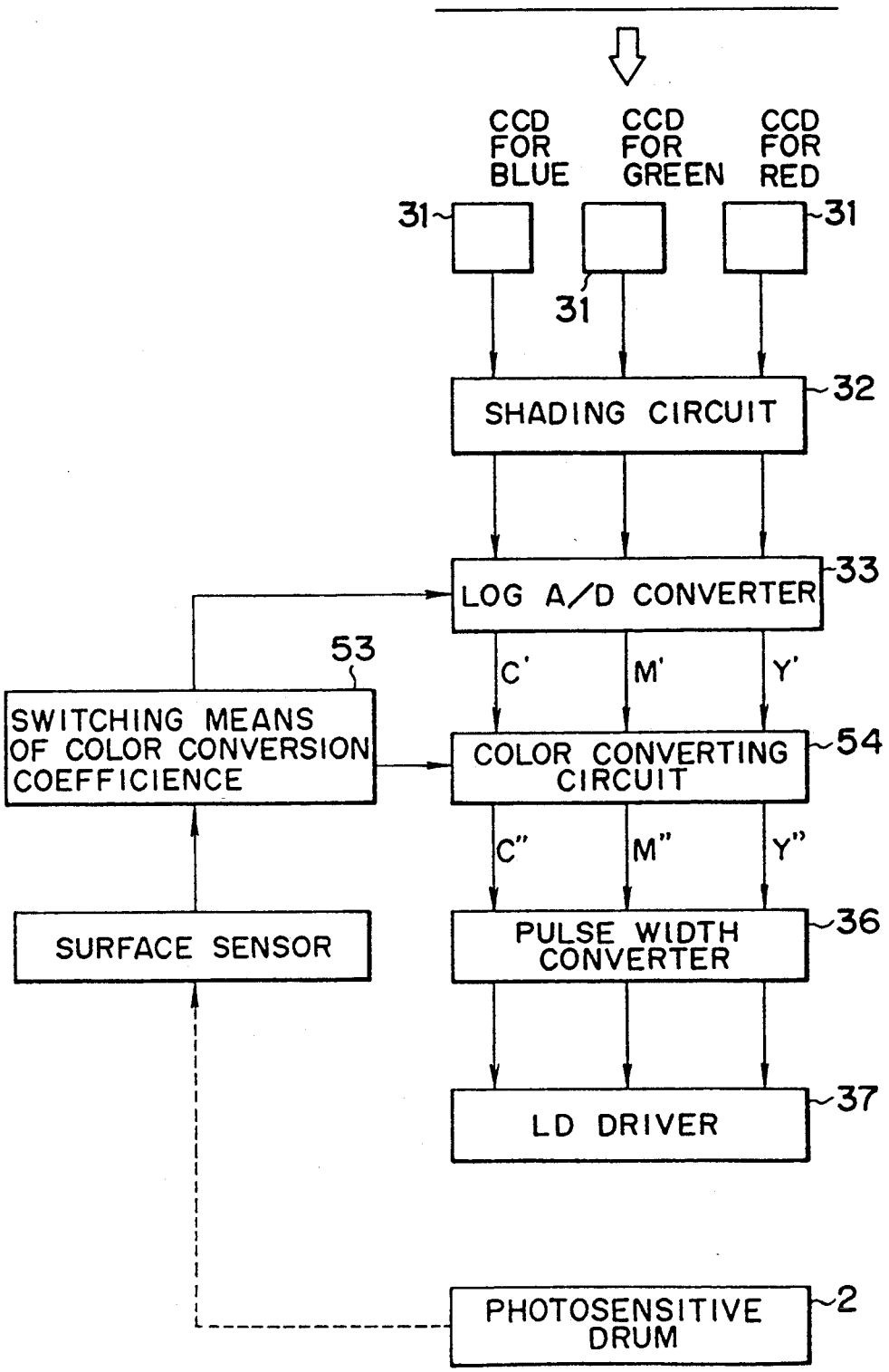
FIG. 9 is a block diagram showing the image signal processing unit of an image forming apparatus applicable to a sixth embodiment according to the present invention.

Also, FIG. 9 is a view showing an image signal processing unit, and a plurality of color converting coefficients are given to the color converting circuit 52. The signals from the surface sensor 30 are transmitted to a color converting coefficient switching means 53 (color converting coefficient instructing means) where an optimal color converting coefficient is selected, and an instruction is issued to the foregoing color converting circuit 54 for the color correction in accordance the aforesaid color converting coefficient.

The measurement of the dark attenuation characteristics is taken in the procedures given below.

Each of the developing devices is in standby in the position opposite to the photosensitive drum 2. Also, both the transfer electrostatic charger 7 and the exposure lamp 10 are turned off to make the inside of the image forming apparatus dark. In this state, approximately a half of the photosensitive drum 2 is charged by the primary electrostatic charger 3. Thus, by the surface sensor 30, the initial surface potential is measured. Also, the surface potential is measured when the photosensitive drum 2 rotates once to make it the final surface potential. At this juncture, since the photosensitive drum 2 is not necessarily an exact circle, the distance between the surface sensor 30 and the photosensitive drum 2 varies inevitably. As a result, in order to make the measured value as close as to the real surface potential, the measurements are performed at plural points, and the averaged value thus obtained will be used because the value of the surface potential is distant-dependent. The dark attenuation characteristic measure in this way is transmitted to the color converting coefficient switching means 53. Also, the exposure lamp 10 is illuminated to deelectrify the photosensitive drum 2 to complete the measurement of the dark attenuation characteristic.

Figure 10:
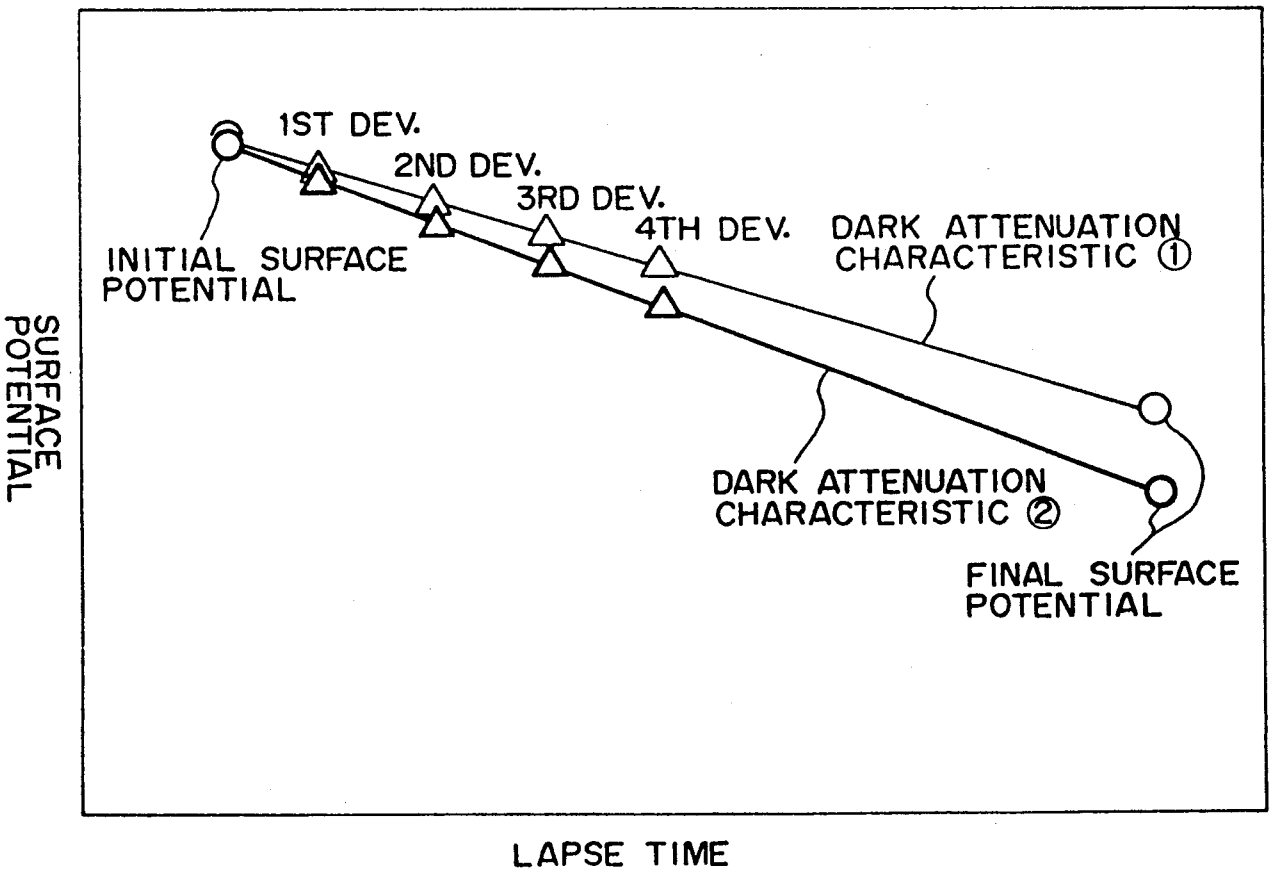
FIG. 10 is a view showing the dark attenuation characteristic of an image forming apparatus applicable to the first embodiment according to the present invention.

The dark attenuation characteristic curve is calculated in accordance with the initial surface potential transmitted to the color converting coefficient switching means 53 and the final surface potential. FIG. 10 shows an example in which a linear interpolation is applied to calculating the aforesaid dark attenuation characteristic curve. However, this interpolating method is not necessarily limited to the linear interpolation. The potentials are obtained when a latent image reaches each of the developing devices using the dark attenuation characteristic curve. Then, by the results thereof, the intermediate gradient tonality is estimated.

On the other hand, since the effect produced by the intermediate gradient tonality on the color reproductivity is known in advance according to experiments, it is possible to select an optimal color converting signal in accordance with the dark attenuation amounts.

Subsequently, the description will be made of the color converting signal switching in conjunction with the above-mentioned FIG. 2 and FIG. 9.

In FIG. 2 and FIG. 9, a reference mark OD designates a signal intensity corresponding to the original density, which serves to be an input signal to the color converting circuit 54; Ex, corresponding to the exposure, which represents the output signal of the color converting circuit 54; further, V, a regulated surface potential; CD, a regulated optical density of the recording image. In FIG. 2 and FIG. 9, when a single color is represented, it is ideal that the OD and CD are in a linear relation as indicated by the solid line DD-1 in the DD zone.

When a color yellow is developed by the yellow developing device 6Y which has the least dark attenuation amount of the four developing devices, the original signal is converted by a color signal −Y to obtain the gradient characteristic having the linear relation at the DD-1 through the ExV characteristic and VD characteristic. However, when a color black is developed by the black developing device 6Bk which has the greatest dark attenuation amount of the four developing devices, the ExV−B is used for the ExV characteristic in ExV zone. If the color converting signal −Y should be used, it would become an unideal DD characteristic such as the DD-2. Therefore, in the present sixth embodiment, the difference of ExV−Y and ExV−B types corresponding to the difference in the dark attenuation amounts is measured in advance, and regarding the B, the color converting signal−B is applied so as to obtain the DD characteristic such as the DD-1. Those which are switched by the color converting coefficient switching means 15 can be either the LOG conversion table and the A/D conversion table in the LOG−A/D converter 14 or the color converting coefficient table in the color converting circuit 53.

In this respect, the measurement of the dark attenuation characteristic can be taken either immediately after the actuation of the image forming apparatus as described above, that is, when the main power source of the apparatus is turned on, or per given number of prints. Further, the measurement can be taken by a timer per given period of time, and it may be arranged that the above-mentioned correction is executed only when the dark attenuation characteristics vary (that is, the case where the dark attenuation characteristic is brought about as ② in FIG. 2).

Also, the charging areas for measuring the dark attenuation characteristics are not limited to those described earlier, but it may be possible to charge the enter photosensitive drum 2 by rotating it once to obtain the average potential from the entire circumference thereof. This is more advantageous because the fluctuations of the electrostatic charging characteristic are offset. Also, it may be possible to speed up the rotation of the photosensitive drum 2 a the time of the dark attenuation characteristic measurement. The rotation of the photosensitive drum 2 is not necessarily limited to only once, either, because it will suffice if only the measurement of the dark attenuation characteristic is taken with a desirable precision. Also, it may be possible to modify and adjust the latent image forming condition and developing condition for each of the developing devices 6 in advance as disclosed in Japanese Patent Laid-Open No. 61-117572, and then, to make the gradient correction by color converting coefficient switching means; hence satisfying the maximum density and gradient tonality at the same time.

Also, while the description has been made of the employment of the so-called inverted development where toners are applied to the areas exposed by a laser light, an image forming apparatus may be such that a regular development is employed in order to apply a toner to a dark area. Also, as an image carrier, it may be possible to use a photosensitive belt such as shown in the foregoing FIG. 3 in place of the photosensitive drum. Further, the foregoing dark attenuation detecting means is not confined to the one described above, but those described in the above-mentioned embodiments can be employed.

As set forth above, according to the sixth embodiment, it is possible to suppress the creation of the color balancing deviation as well as to prevent image defective from being generated even when the dark attenuation characteristic varies because it is arranged that the dark attenuation characteristic of the photosensitive drum is measured when the color correction is provided for the original density signal, and then, the color correction is made by selecting the optimal color correction coefficient on the basis of the result of the foregoing measurement.

What is claimed is:

1. An electrophotographing apparatus for forming color image, comprising:

an electrophotographing photosensitive member which travels endlessly;

electrostatic charging means for charging the photosensitive member before optical information is irradiated thereonto;

optical means for irradiating color image information onto said photosensitive member;

a plurality of color developing means each having a toner of different color, said plural color developing means being arranged sequentially on the downstream side of a position where the optical information is irradiated by said optical means in observing them in the traveling direction of the photosensitive member;

dark attenuation amount detecting means for detecting the dark attenuation amount of the photosensitive member in the position of each developing device; and gradient correcting means for correcting the gradation of a developing image by each of the developing means in accordance with the result of the detection by said dark attenuation amount detecting means.

2. An electrophotographing apparatus according to claim 1, wherein said dark attenuation detecting means has a surface potential sensor for detecting the surface potential of the photosensitive member, for detecting the potential by said surface potentials sensor after the photosensitive member is charged by said electrostatic means, for detecting the difference in the result of this detection and a potential subsequent to a given rotation of said photosensitive member, and for calculating the dark attenuation amount of the photosensitive member in the position of each developing device in accordance with the relationship between the result of this detection and the time required for the photosensitive member to rotate for a given amount.

3. An electrophotographing apparatus according to claim 1 wherein said dark attenuation amount detecting means has a surface potential sensor for detecting the surface potential of the photosensitive member, for detecting the potential by the surface potential sensor after the photosensitive member is charged by said electrostatic charging means, then for suspending the movement of the photosensitive member to detect the difference in a potential in a given position after a given time elapses, and for calculating the dark attenuation amount of the photosensitive member in the position of each developing device in accordance with the result of this detection.

4. An electrophotographing apparatus according to claim 1, wherein said dark attenuation amount detecting means has a plurality of surface potential sensors for detecting the surface potential in the traveling direction of the photosensitive member.

5. An electrophotographing apparatus for forming a color image, comprising:

an electrophotographing photosensitive member which travels endlessly;

electrostatic charging means for charging the photosensitive member before optical information is irradiated onto said photosensitive member;

optical means for irradiating color image information onto said photosensitive member;

a plurality of color developing means each having a toner of different color, said plural color developing means being arranged sequentially on the downstream side of a position where the optical information is irradiated by said optical means in observing them in the traveling direction of the photosensitive member;

dark attenuation amount detecting means for detecting the dark attenuation amount of the photosensitive member in the position of each developing device; and color correcting means for correcting the color of a developing image by each of the developing means in accordance with the result of the detection by said dark attenuation amount detecting means.

6. An electrophotographing apparatus according to claim 5, wherein said color correcting means makes correction in accordance with the color correcting coefficient for the color of each developing means.

7. An electrophotographing apparatus according to claim 5, wherein said dark attenuation detecting means has a surface potential sensor for detecting the surface potential of the photosensitive member, for detecting the potential by said surface potentials sensor after the photosensitive member is charged by said electrostatic means, for detecting the difference in the result of this detection and a potential subsequent to a given rotation of said photosensitive member, and for calculating the dark attenuation amount of the photosensitive member in the position of each developing device in accordance with the relationship between the result of this detection and the time required for the photosensitive member to rotate for a given amount.

8. An electrophotographing apparatus according to claim 5, wherein said dark attenuation amount detecting means has a surface potential sensor for detecting the surface potential of the photosensitive member, for detecting the potential by the surface potential sensor after the photosensitive member is charged by said electrostatic charging means, then for suspending the movement of the photosensitive member to detect the difference in a potential in a given position after a given time elapses, and for calculating the dark attenuation amount of the photosensitive member in the position of each developing device in accordance with the result of this detection.

9. An electrophotographing apparatus according to claim 5, wherein, said dark attenuation amount detecting means has a plurality of surface potential sensors for detecting the surface potential in the traveling direction of the photosensitive member.

* * * * *

UNITED STATES PATENT AND TRADEMARK OFFICE

CERTIFICATE OF CORRECTION

PATENT NO. : 5,319,433

DATED : June 7, 1994

INVENTOR(S) : Fukushima, et al.

It is certified that error appears in the above-identified patent and that said Letters Patent is hereby corrected as shown below:

COLUMN 2

Line 36, "member" should read --member.--.

COLUMN 3

Line 56, "loner" should read --longer--; and
Line 68, "sheets" should read --sheets P--.

COLUMN 6

Line 11, "6 Bk" should read --6Bk--; and
Line 16, "sensitometory" should read --sensitometry--.

COLUMN 7

Line 64, "drum" should read --drum 2--.

Signed and Sealed this

Third Day of January, 1995

*Attest:*

*Attesting Officer*

BRUCE LEHMAN

*Commissioner of Patents and Trademarks*